US009881538B2

(12) United States Patent
Lin

(10) Patent No.: US 9,881,538 B2
(45) Date of Patent: Jan. 30, 2018

(54) DISPLAY SYSTEM AND METHOD FOR DRIVING PIXELS OF THE DISPLAY SYSTEM

(71) Applicant: HIMAX TECHNOLOGIES LIMITED, Tainan (TW)

(72) Inventor: Chih-Feng Lin, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 104 days.

(21) Appl. No.: 14/807,871

(22) Filed: Jul. 23, 2015

(65) Prior Publication Data

US 2017/0025052 A1 Jan. 26, 2017

(51) Int. Cl.
*G09G 3/20* (2006.01)

(52) U.S. Cl.
CPC ... *G09G 3/2003* (2013.01); *G09G 2300/0452* (2013.01); *G09G 2320/0242* (2013.01); *G09G 2320/0285* (2013.01); *G09G 2320/0666* (2013.01); *G09G 2340/0457* (2013.01)

(58) Field of Classification Search
CPC ..... G09G 3/2003; G09G 3/3607; G09G 2300/0452; G09G 2320/0242; G09G 2320/0285; G09G 2340/0457; G09G 3/20
See application file for complete search history.

(56) References Cited

U.S. PATENT DOCUMENTS

2006/0158466 A1* 7/2006 Chien ..... G09G 3/2074 345/694
2008/0056604 A1* 3/2008 Choe ..... G09G 3/2003 382/269
2008/0186325 A1* 8/2008 Higgins ..... G06T 11/001 345/592
2009/0167779 A1* 7/2009 Inuzuka ..... G09G 3/2003 345/589
2010/0201701 A1* 8/2010 Toji ..... G09G 3/2003 345/589
2012/0287172 A1* 11/2012 Lin ..... G09G 3/3426 345/690
2013/0106891 A1* 5/2013 Matsueda ..... G09G 3/2003 345/589
2014/0362127 A1* 12/2014 Yang ..... G09G 3/2003 345/690

(Continued)

FOREIGN PATENT DOCUMENTS

CN 101814283 A 8/2010
TW 201320040 A 5/2013
TW 201447427 A 12/2014

*Primary Examiner* — Pegeman Karimi
(74) *Attorney, Agent, or Firm* — CKC & Partners Co., Ltd.

(57) ABSTRACT

A display system includes a sub-pixel rendering unit, a detection unit, a compensation unit, and a data re-arrangement unit. The sub-pixel rendering unit is configured to generate first pixel values for pixels according to a video signal. The detection unit is configured to detect whether at least one of predetermined conditions is present in a content of the video signal, so as to generate a control code. The compensation unit is configured to generate a second pixel values for the pixels according to the video signal and the control code. The data re-arrangement unit is configured to selectively output at least one of the first pixel values and the second pixel values to the pixels according to the control code.

16 Claims, 7 Drawing Sheets

(56) References Cited

U.S. PATENT DOCUMENTS

| | | | | |
|---|---|---|---|---|
| 2016/0063908 | A1* | 3/2016 | Lin | G09G 3/2003 345/694 |
| 2016/0267685 | A1* | 9/2016 | Yang | G09G 3/2003 |
| 2016/0335741 | A1* | 11/2016 | Zhao | G06T 3/40 |

* cited by examiner

DISPLAY SYSTEM AND METHOD FOR DRIVING PIXELS OF THE DISPLAY SYSTEM

BACKGROUND

Technical Field

The present disclosure relates to a display system. More particularly, the present disclosure relates to the display system having a color compensation for sub-pixels.

Description of Related Art

Display devices are commonly used in a variety of electronic products. Pixels of a display panel are divided into three sub-pixels, and thus each of the sub-pixels can be driven individually.

However, as the development of the resolution of the display panel, the size of the sub-pixels is limited. As a result, an aperture ration is reduced, and a difficulty of manufacture is increased.

Furthermore, when certain conditions, such as a single dot, a line, or texts, are present in the image, the color balance or the contrast of the display panel may be reduced with limitation of the sub-pixels.

SUMMARY

One aspect of the present disclosure is to provide a display system. The display system includes a sub-pixel rendering unit, a detection unit, a compensation unit, and a data re-arrangement unit. The sub-pixel rendering unit is configured to generate first pixel values for pixels according to a video signal. The detection unit is configured to detect whether at least one of predetermined conditions is present in a content of the video signal, so as to generate a control code. The compensation unit is configured to generate a second pixel values for the pixels according to the video signal and the control code. The data re-arrangement unit is configured to selectively output at least one of the first pixel values and the second pixel values to the pixels according to the control code.

Another aspect of the present disclosure is to provide a method. The method includes following steps: generating first pixel values for pixels, by a sub-pixel rendering unit, according to a video signal; detecting whether at least one of predetermined conditions is present in a content of the video signal, by a detection unit, so as to generate a control code; generating second pixel values for the pixels, by a compensation unit, according to the video signal and the control code; and selectively outputting at least one of the first pixel values and the second pixel values to the pixels, by a data re-arrangement unit, according to the control code.

In summary, the display system and the driving method of the present disclosure are able to improve the image quality from the panel.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
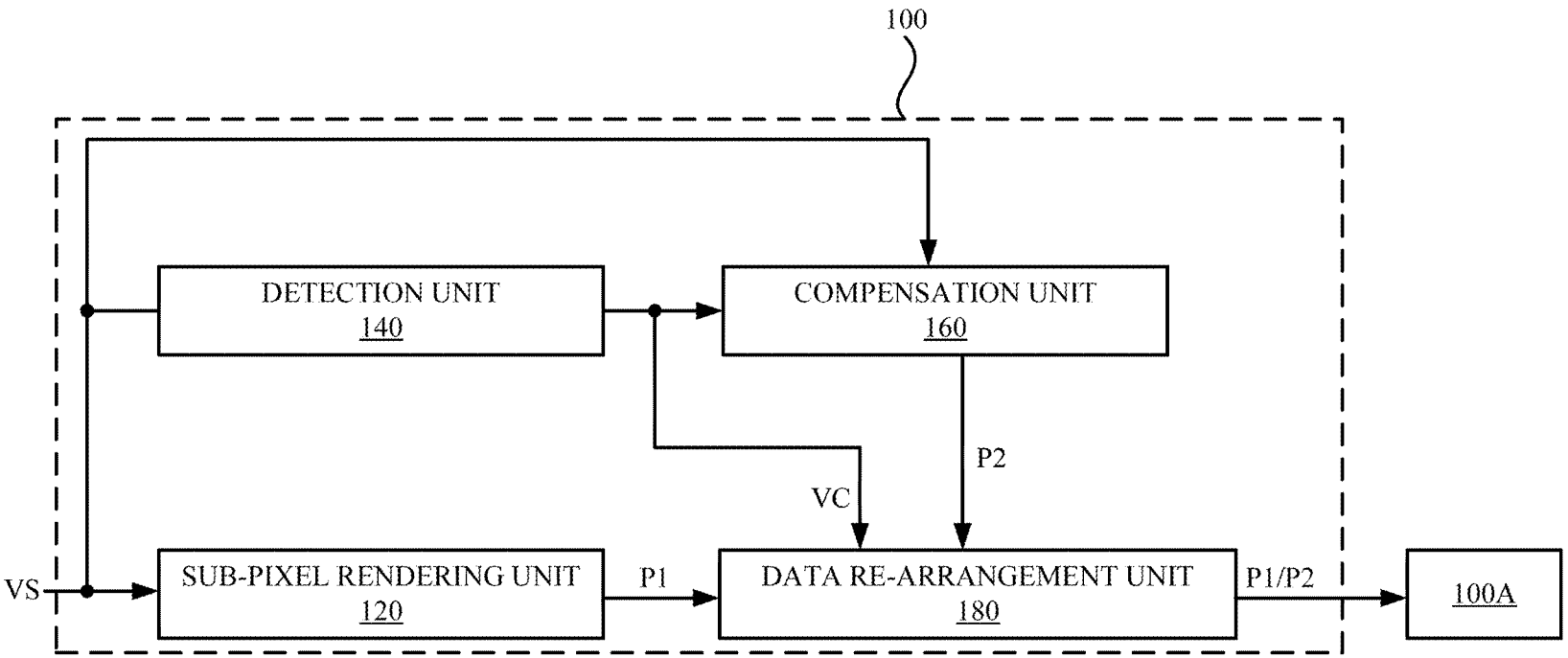
FIG. 1 is a schematic diagram of a display system, according to various embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

Although the terms "first," "second," etc., may be used herein to describe various elements, these elements should not be limited by these terms. These terms are used to distinguish one element from another.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

In this document, the term "coupled" may also be termed as "electrically coupled", and the term "connected" may be termed as "electrically connected". "Coupled" and "connected" may also be used to indicate that two or more elements cooperate or interact with each other.

Reference is made to FIG. 1. FIG. 1 is a schematic diagram of a display system, according to various embodiments of the present disclosure. As shown in FIG. 1, the display system 100 is configured to drive pixels (not shown) in a panel 100A.

In some embodiments, the display system 100 includes a sub-pixel rendering unit 120, a detection unit 140, a compensation unit 160, and a data re-arrangement unit 180. The sub-pixel rendering unit 120 is configured to receive a video signal VS, and to generate pixel values P1 for the pixels in the panel 100A according to the video signal VS. In various embodiments, for each of the pixels, the video signal VS includes data values R, G, and B, where the data value R is indicative of a pixel value for displaying red, the data value G is indicative of a pixel value for displaying green, and the data value B is indicative of a pixel value for displaying blue. In some embodiments, the sub-pixel rendering unit 120 is a 3-order finite impulse response (FIR) low-pass filter. In other words, for each of the pixels, the sub-pixel rendering unit 120 is able to generate the corresponding pixel values P1 according to the data values of the video signal VS, so as to drive the pixels with two sub-pixels. In some another embodiments, said low-pass filter is employed in one-dimension. In yet other embodiments, said low-pass filter is employed in two-dimension.

The detection unit 140 is configured to detect whether at least one predetermined conditions is present in a content of the video signal VS, so as to generate a control code VC. In various embodiments, the predetermined conditions include a single dot, lines, and texts in the content of the video signal VS. In greater detail, the content of the video signal VS is formed by the data values R, G, and B, of the video signal VS. Thus, the detection unit 140 is able to identify whether the single dot, lines, or texts is present in the content by utilizing the data values R, G, and B, of the video signal VS.

The compensation unit 160 is configured to generate pixel values P2 for the pixels in the panel 100A according to the control code VC and the video signal VS. For example, when the detection unit 140 detects that the single dot, lines, or texts is present in the content, the detect unit 140 generates the control code VC with a corresponding status. Accordingly, the compensation unit 160 is able to generate the pixel values P2 for the pixels forming the single dot, lines, or texts, so as to compensate the color balance and the contrast of the content.

The data re-arrangement unit 180 is configured to selectively output at least one of the pixel values P1 and the pixel values P2 to the pixels according to the control code VC. Through such arrangement, the quality of images displayed by the panel 100A is improved.

The following paragraphs provide various embodiments related to the display system 100 to illustrate functions and applications thereof. The present disclosure is not limited to the following embodiments.

Figure 2:
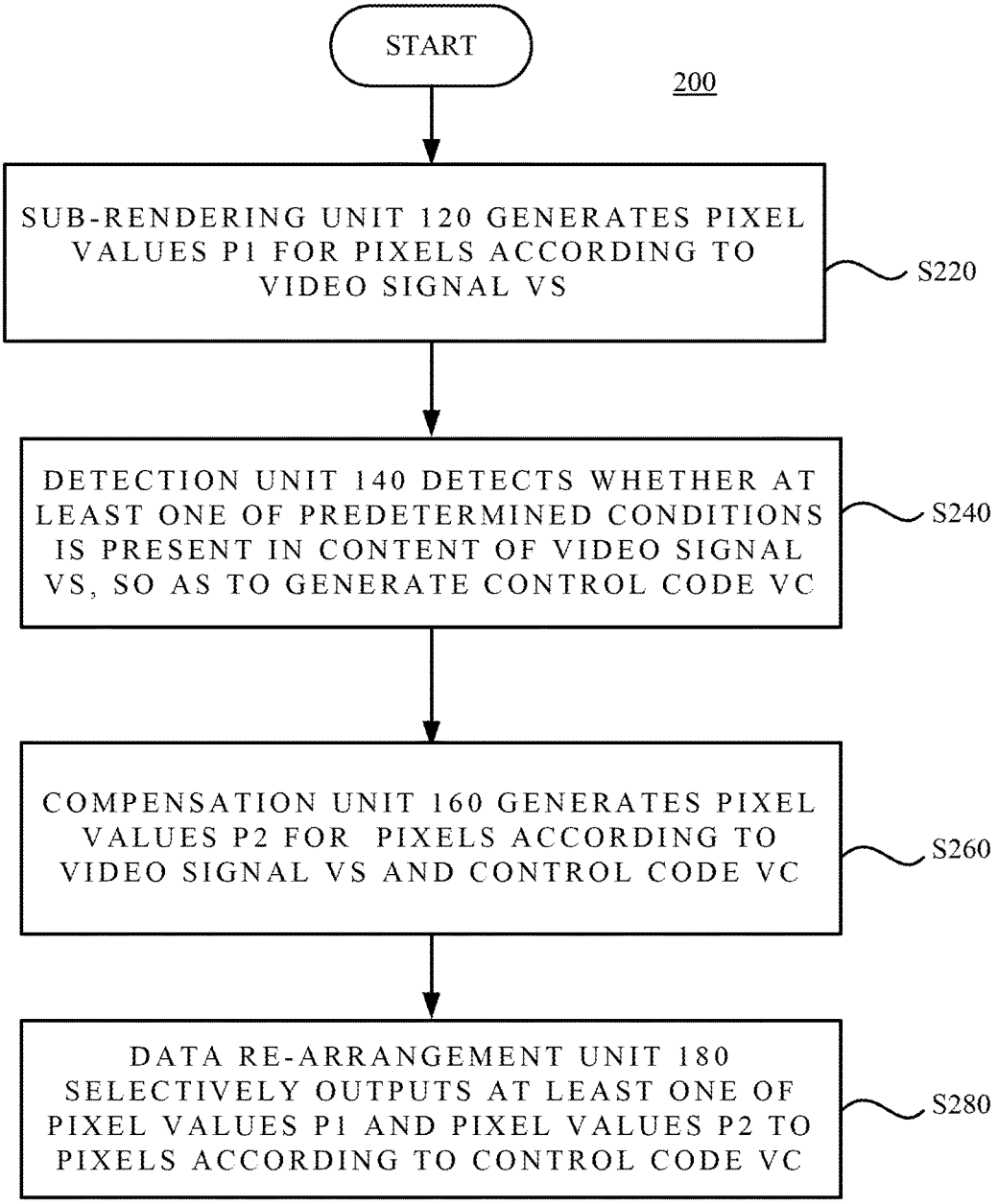
FIG. 2 is a flow chart of a driving method according to some embodiments of the present disclosure.
Figure 3A:
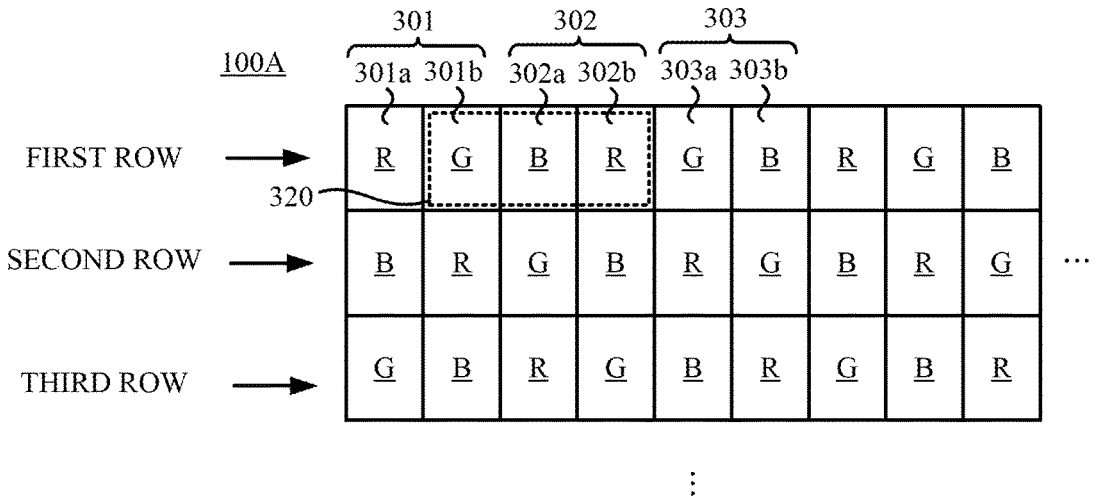
FIG. 3A is a schematic diagram illustrating one arrangement of the pixels in the panel in FIG. 1, according to some embodiments of the present disclosure.

FIG. 2 is a flow chart of a driving method 200 according to some embodiments of the present disclosure. FIG. 3A is a schematic diagram illustrating one arrangement of the pixels in the panel 100A in FIG. 1, according to some embodiments of the present disclosure. The driving method 200 is applicable to the display system 100, but is not limited thereto. For simplicity, reference is now made to FIG. 1, FIG. 2, and FIG. 3A, and the operations of the display system 100 are described with the driving method 200.

As shown in FIG. 2, the driving method 200 includes step S220, step S240, step S260, and step S280. In step 220, the sub-rendering unit 120 generates pixel values P1 for the pixels according to the video signal VS.

For example, in some embodiments, as shown in FIG. 3A, the pixels in the panel 100A are arranged in row and columns. The pixels include a pixel 301, a pixel 302, and a pixel 303. The pixel 301, the pixel 302 and the pixel 303 are sequentially arranged in a horizontal direction (i.e., the first row). Each of the pixel 301, the pixel 302 and the pixel 303 includes two sub-pixels, such as a sub-pixel 301*a*, a sub-pixel 301*b*, a sub-pixel 302*a*, a sub-pixel 302*b*, a sub-pixel 303*a*, and a sub-pixel 303*b*. Two sub-pixels of each of the pixel 301, the pixel 302, and the pixel 303 are configured to display two different colors. For example, as shown in FIG. 3A, the sub-pixel 301*a* is configured to display red, the sub-pixel 301*b* is configured to display green, and the sub-pixel 302*a* is configured to display blue. In this embodiment, the sub-pixels in the first row are configured to sequentially display red, green and blue, the sub-pixels in the second row are configured to sequentially display blue, red, and green, and the sub-pixels in the third row are configured to sequentially display green, blue, and red.

In greater detail, taking the sub-pixel 302*a* as an example, the sub-rendering unit 120 is able to generate the pixel value P1 for the sub-pixel 302*a* of the pixel 302 according to weighted coefficients WR1 between the pixel 302 and the pixels around the pixel 302, and data values of the color corresponding to the sub-pixel 302*a*, i.e., blue, and the pixels around the pixel 302, of the video signal VS. For example, the sub-rendering unit 120 determines the weighted coefficients WR1 according to a predetermined region 320, areas of the predetermined region 320 covered by the pixel 301, the pixel 302 and the pixel 303. An area of each of the sub-pixels in the panel 100A is set to 8. The area of the predetermined region 320 is 24. The area of the predetermine region 320 covered by the pixel 301 is 8. The area of the predetermine region 320 covered by the pixel 302 is 16. The area of the predetermine region 320 covered by the pixel 303 is 0. Thus, the weighted coefficients WR1 for the sub-pixel 302*a* can be derived as the following equation (1). As a result, the pixel value P1 for the sub-pixel 302*a* can be derived as the following equation (2), where B1 is the data value of blue, corresponding to the pixel 301, of the video signal VS, B2 is the data value of blue, corresponding to the pixel 302, of the video signal VS, and B3 is the data value of blue, corresponding to the pixel 303, of the video signal VS.

$$WR1 = [8 \quad 16 \quad 0]/24 = \left[\frac{1}{3} \quad \frac{2}{3} \quad 0\right] \tag{1}$$

$$P1 = \left[\frac{1}{3} \quad \frac{2}{3} \quad 0\right]\begin{bmatrix} B1 \\ B2 \\ B3 \end{bmatrix} \tag{2}$$

Similarly, with same calculation, the sub-rendering unit 120 is able to derive the weighted coefficients WR2 for the sub-pixel 302*b* from the following equation (3). As a result, the pixel value P1 for the sub-pixel 302*b* can be derived as the following equation (4), where R1 is the data value of red, corresponding to the pixel 301, of the video signal VS, R2 is the data value of red, corresponding to the pixel 302, of the video signal VS, and R3 is the data value of red, corresponding to the pixel 303, of the video signal VS.

$$WR2 = [0 \quad 16 \quad 8]/24 = \left[0 \quad \frac{2}{3} \quad \frac{1}{3}\right] \tag{3}$$

$$P1 = \left[0 \quad \frac{2}{3} \quad \frac{1}{3}\right]\begin{bmatrix} R1 \\ R2 \\ R3 \end{bmatrix} \tag{4}$$

As a rule, in this embodiment, the weighted coefficients WR1 can be utilized for determining the pixel values P1 of the left sub-pixel of the pixels (e.g., sub-pixels 301*a*, 302*a*, and 303*a*). The weighted coefficients WR2 can be utilized for determining the pixel values P1 of the right sub-pixel of the pixels (e.g., sub-pixels 301*b*, 302*b*, and 303*b*).

Figure 3B:
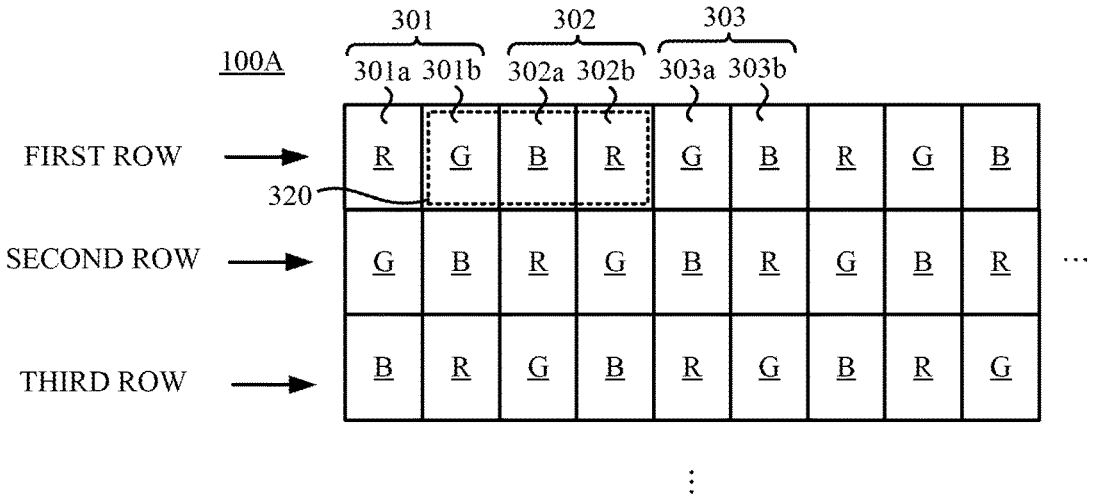
FIG. 3B is a schematic diagram illustrating one arrangement of the pixels in the panel in FIG. 1, according to some embodiments of the present disclosure.

Reference is now made to FIG. 3B. FIG. 3B is a schematic diagram illustrating one arrangement of the pixels in the panel 100A in FIG. 1, according to some embodiments of the present disclosure. Compared to FIG. 3A, the sub-pixels in the second row are configured to sequentially display blue, red, and green, and the sub-pixels in the third row are configured to sequentially display blue, red, and green. Similarly, in this embodiment, the weighted coefficients WR1 can be utilized for determining the pixel values P1 of the left sub-pixel of the pixels (e.g., sub-pixels 301*a*, 302*a*, and 303*a*). The weighted coefficients WR2 can be utilized for determining the pixel values P1 of the right sub-pixel of the pixels (e.g., sub-pixels 301*b*, 302*b*, and 303*b*). Thus, the repetitious descriptions are not given here.

Figure 3C:
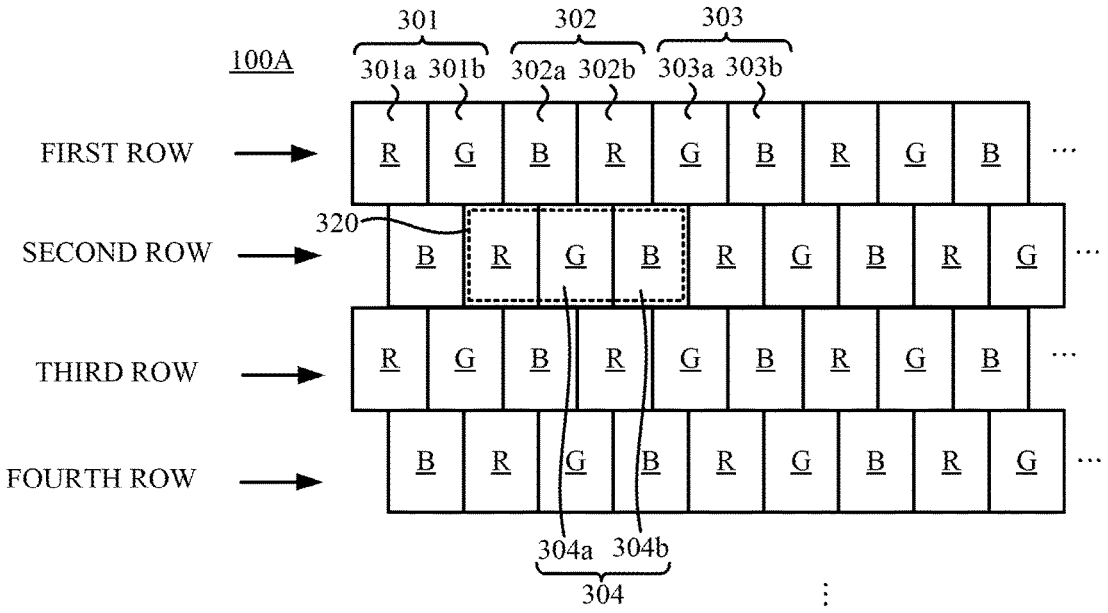
FIG. 3C is a schematic diagram illustrating one arrangement of the pixels in the panel in FIG. 1, according to some embodiments of the present disclosure.

Reference is now made to FIG. 3C. FIG. 3C is a schematic diagram illustrating one arrangement of the pixels in the panel 100A in FIG. 1, according to some embodiments of the present disclosure.

Compared to FIG. 3A, the arrangement for the pixels in odd rows of the panel 100A in FIG. 3C is same as the arrangement for the pixels in odd rows of the panel 100A in FIG. 3A. Compared to FIG. 3A, the arrangement for the pixels in even rows of the panel 100A in FIG. 3C are shifted left by a half of the length of the sub-pixel. In some embodiments, the pixels in the odd rows, for example, including the first row and the third row, are configured to sequentially display red, green, and blue, and the pixels in the even rows, for example, including the second row and the fourth row, are configured to sequentially display blue, red, and green. In other words, as shown in FIG. 3C, a first color group (i.e., red, green, and blue) and a second color group (i.e., blue, red, and green) are alternately displayed by the rows in the panel 100A. In this embodiment, the weighted coefficients WR1 can be utilized for determining the pixel values P1 of the left sub-pixel of the pixels (e.g., sub-pixels 301*a*, 302*a*, and 303*a*) at the odd rows. The weighted coefficients WR2 can be utilized for determining the pixel values P1 of the right sub-pixel of the pixels (e.g., sub-pixels 301*b*, 302*b*, and 303*b*) at the even rows. For the even rows, as mentioned above, by using the predetermined region 320, the sub-rendering unit 120 is able to determine weighted coefficients WR3 for the sub-pixel 304*a* of the pixel 304 (i.e., the sub-pixel at center of the pixels at the even rows) and weighted coefficients WR4 for the sub-pixel 304*b* of the pixel 304 (i.e., the sub-pixel at right side of the pixels at the even rows). The weighted coefficients WR3 and the weighted coefficients WR4 can be derived as the following equation (5). Thus, with the weighted coefficients WR1-4, the sub-rendering unit 120 is able to generate the pixel values P1 for each pixel, and the repetitious descriptions are not given here.

$$WR3 = [4 \quad 16 \quad 4]/24 = \left[\frac{1}{6} \quad \frac{4}{6} \quad \frac{1}{6}\right] \tag{5}$$

$$WR4 = [0 \quad 12 \quad 12]/24 = \left[0 \quad \frac{1}{2} \quad \frac{1}{2}\right]$$

Figure 3D:
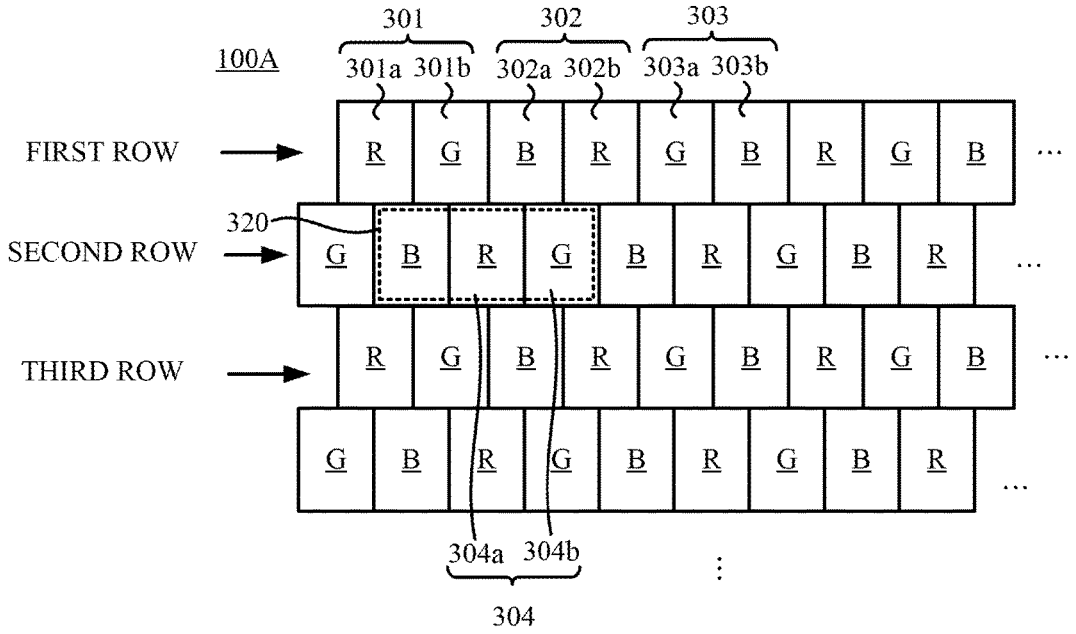
FIG. 3D is a schematic diagram illustrating one arrangement of the pixels in the panel in FIG. 1, according to some embodiments of the present disclosure.

Reference is now made to FIG. 3D. FIG. 3D is a schematic diagram illustrating one arrangement of the pixels in the panel 100A in FIG. 1, according to some embodiments of the present disclosure. Compared to FIG. 3A and FIG. 3C, the arrangement for the pixels in even rows of the panel 100A in FIG. 3D are shifted right by a half of the length of the sub-pixel. In some embodiments, the pixels in the odd rows, for example, including the first row and the third row, are configured to sequentially display red, green, and blue, and the even rows, for example, including the second row and the fourth row, are configured to sequentially display green, blue, and red. In other words, as shown in FIG. 3D, the first color group (i.e., red, green, and blue) and a third color group (i.e., green, blue, and red) are alternately displayed by the rows in the panel 100A. Similarly, in this embodiment, with the weighted coefficients WR1-4 mentioned above, the sub-rendering unit 120 is able to generate the pixel values P1 for each pixel, and thus the repetitious descriptions are not given here.

Figure 3E:
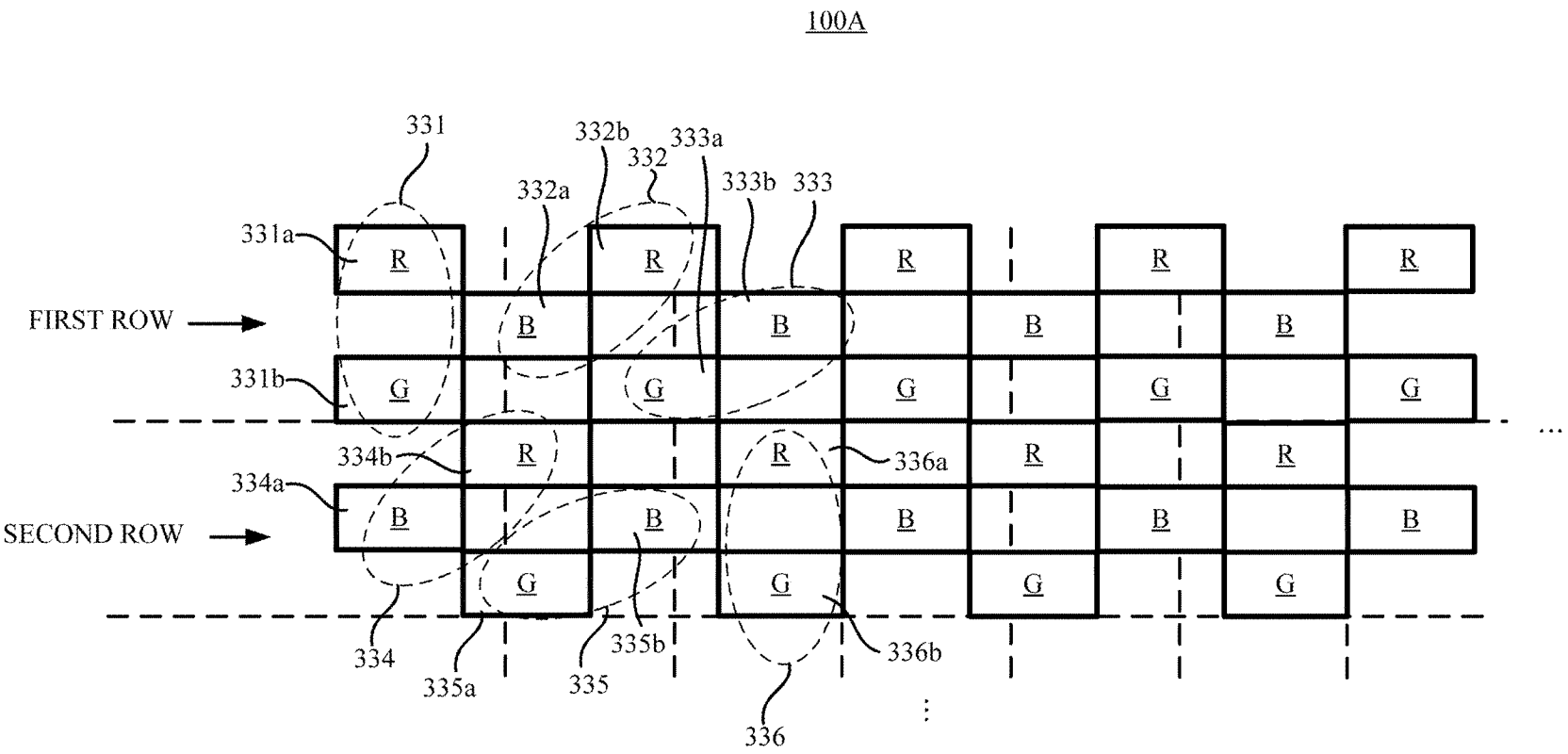
FIG. 3E is a schematic diagram illustrating one arrangement of the pixels in the panel in FIG. 1, according to some embodiments of the present disclosure.

Reference is now made to FIG. 3E. FIG. 3E is a schematic diagram illustrating one arrangement of the pixels in the panel 100A in FIG. 1, according to some embodiments of the present disclosure. As shown in FIG. 3E, compared to FIGS. 3A-3D, the sub-pixels in each row of the panel 100A are further arranged in a delta arrangement. In great detail, the first row of the panel 100A includes a pixel 331, a pixel 332, a pixel 333, a pixel 334, a pixel 335, and a pixel 336. A sub-pixel 331*a* of the pixel 331, a sub-pixel 331*b* of the pixel 331, and a sub-pixel 332*a* of the pixel 332 substantially form a triangle, in which the sub-pixel 331*b* is disposed underneath the sub-pixel 331*a*, and the sub-pixel 332*a* is disposed among the sub-pixels 331*a* and 331*b*. For the second row, the arrangement of the pixel 334, the pixel 335, and the pixel 336 are similar with the arrangement of the first row. Thus, the repetitious descriptions are not given here.

With continued reference to FIG. 2, in step S240, the detection unit 140 detects whether at least one of predetermined conditions is present in the content of the video signal VS, so as to generate the control code VC. In step S260, the compensation unit 160 generates the pixel values P2 for the pixels according to the video signal VS and the control code VC.

Figure 4A:
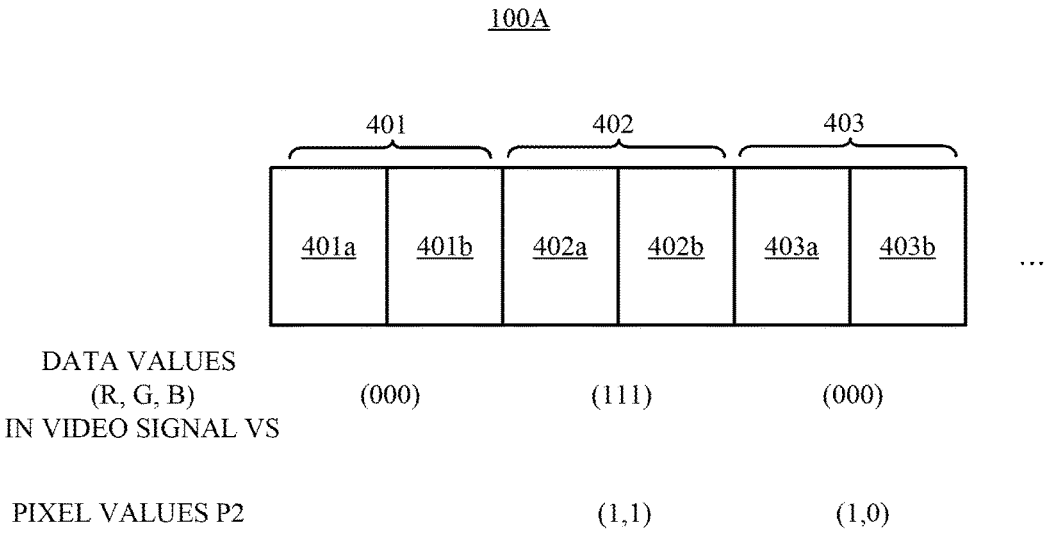
FIG. 4A is a schematic diagram illustrating operations of generating pixels values P2 for the pixels according to some embodiments of the present disclosure.

Reference is now made to FIG. 4A. FIG. 4A is a schematic diagram illustrating operations of generating the pixels values P2 for the pixels according to some embodiments of the present disclosure. For simplicity, FIG. 4A only shows three pixels 401, 402, and 403 that are sequentially arranged in a row.

In some embodiments, the detection unit 140 is configured to generate a difference values ΔP21(x) and difference values ΔP23(x) according to data values, corresponding to the pixel 401, the pixel 402, and the pixel 403, of the video signal VS. The detection unit 140 compares the difference values ΔP21(x) and the difference values ΔP23(x) with a positive threshold value DHT and a negative threshold value −(DHT), so as to generate the control code VC. In various embodiments, the positive threshold value DHT and the negative threshold value −(DHT) can be adjusted according to requirements of actual applications.

In greater details, the difference values ΔP21(x) are difference between data values R, G, and B, corresponding to the pixel 401, of the video signal VS and data values of R, G, and B, corresponding to the pixel 402, of the video signal VS, respectively. Similarly, the difference values ΔP23(x) are difference between data values R, G, and B, corresponding to the pixel 402, of the video signal VS and data values R, G, and B, corresponding to the pixel 403, of the video signal VS, respectively. In other words, the detection unit 140 is able to generate the difference values ΔP21(x) and the difference values ΔP23(x) with the following equations.

$$\Delta P21(x)=P2(x)-P1(x), x=R,G,B$$

$$\Delta P23(x)=P2(x)-P3(x), x=R,G,B$$

Where the P1(x), P2(x), and P3(x) are referred to as the data values of R, G, and B for the pixel 401, the pixel 402, and the pixel 403. Thus, the detection unit 140 further compares the difference values ΔP21(x) and the difference values ΔP23(x) with the positive threshold value DHT and the negative threshold value −(DHT), so as to identify whether the predetermined conditions are present in the content of the video signal VS.

For illustration, as shown in FIG. 4A, the data values R, G, and B, corresponding to the pixel 401, of the video signal VS is (000). The data values R, G, and B, corresponding to the pixel 402, of the video signal VS is (111). The data values R, G, and B, corresponding to the pixel 403, of the video signal VS is (000). In other words, the pixel 401 is expected to display black, the pixel 402 is expected to display white, and the pixel 403 is expected to display black. That is, an extreme color transition from black to white is present in the successive pixels. In general, such color transition is present when the single dot, texts or lines are present in the content. Under this circumstance, the detection unit 140 obtains that the difference values ΔP21(R)=1, ΔP21(G)=1, and ΔP21(B)=1, and the difference values ΔP23(R)=1, ΔP23(G)=1, ΔP23(B)=1. By comparing those difference values with the positive threshold value DHT and the negative threshold value −(DHT), the detection unit 140 determines that those difference values are greater than the positive threshold value DHT, and thus determines that the single dot, texts or lines are present in the content. Accordingly, the detection unit 140 outputs the control code VC with a corresponding status.

Further, when receiving the control code VC, the compensation unit 160 generates pixel values P2 for the pixels 402 according to the video signal VS, so as to compensate the color balance of the content. In greater detail, for arrangements shown in FIGS. 3A-3D, when one of the difference values ΔP21(x) and one of the difference values ΔP23(x) are greater than the positive threshold value DHT, the compensation unit 160 generates a first one of the pixel values P2 as being a predetermined portion of the data value R, corresponding to the pixel 402, of the video signal VS. The compensation unit 160 generates a second one of the pixel values P2 as being the predetermined portion of the data value G, corresponding to the pixel 402, of the video signal VS. To compensate the color balance, the compensation unit 160 generates a third one of the pixel values P2 as being the predetermined portion of the data value B, corresponding to the pixel 403, of the video signal VS. The first one of the pixel values P2 corresponds to the sub-pixel 402*a* of the pixel 402, and the second one of the pixel values P2 corresponds to the sub-pixel 402*b* of the pixel 402, and the third one of the pixel values P2 corresponds to the sub-pixel 403*a* of the pixel 403.

In various embodiments, the predetermined portion can be adjusted for adjusting the luminance of the panel 100A according to requirements of actual applications. For example, in this embodiment, the predetermined portion is set to 1. In other words, as shown in FIG. 4A, the compensation unit 160 keeps the first one of the pixel values P2 being same as the data value R, corresponding to the pixel 402, of the video signal VS for the sub-pixel 402*a*. The compensation unit 160 keeps the second one of the pixel values P2 being same as the data value G, corresponding to the pixel 402, of the video signal VS for the sub-pixel 402*b*. Such operation is referred to as a "keep operation" hereinafter. Further, the compensation unit 160 keeps the third one of the pixel values P2 being same as the data value B, corresponding to the pixel 402, of the video signal VS for the sub-pixel 403*a*. That is, the first one and the second one of the pixel values P2 for the pixel 402 are (1, 1). Effectively, the sub-pixel 403*a* of the pixel 403 is borrowed for displaying white with the pixel 402. Such operation is referred to as a "borrow operation" hereinafter. As a result, the color balance and the contrast of the image displayed by the panel 100A are improved.

Figure 4B:
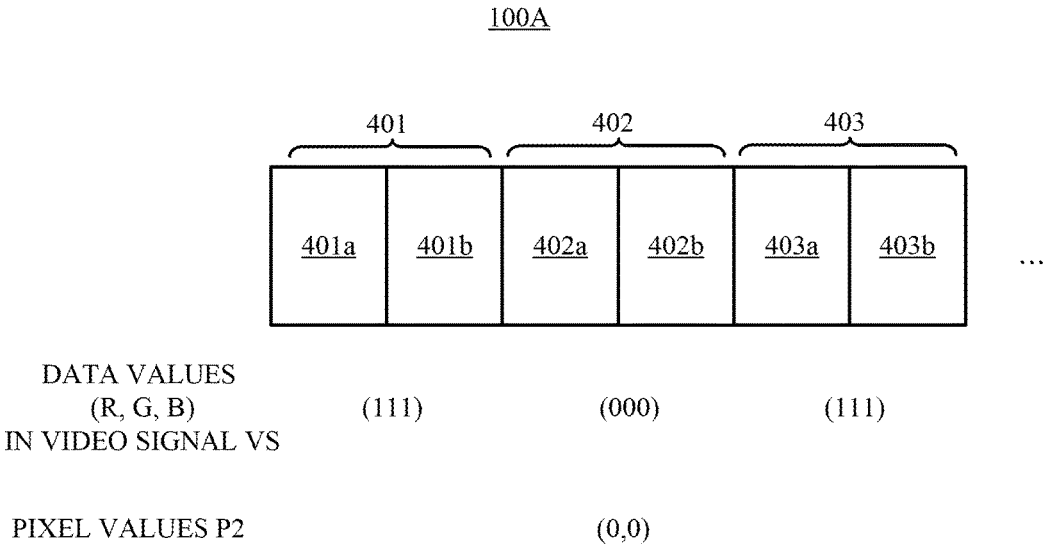
FIG. 4B is a schematic diagram illustrating operations of generating pixels values P2 for the pixels according to some embodiments of the present disclosure.

Reference is now made to FIG. 4B. FIG. 4B is a schematic diagram illustrating operations of generating pixels values P2 for the pixels according to some embodiments of the present disclosure. Compared to FIG. 4A, in this example, the data values R, G, and B, corresponding to the pixel 401, of the video signal VS is (111). The data values R, G, and B, corresponding to the pixel 402, of the video signal VS is (000). The data values R, G, and B, corresponding to the pixel 403, of the video signal VS is (111). In other words, the pixel 401 is expected to display white, the pixel 402 is expected to display black, and the pixel 403 is expected to display white. That is, another extreme color transition from white to black is present in the successive pixels. Under this circumstance, the detection unit 140 obtains that the difference values ΔP21(R)=−1, ΔP21(G)=−1, and ΔP21(B)=−1, and the difference values ΔP23(R)=−1, ΔP23(G)=−1, ΔP23(B)=−1. By comparing those difference values with the positive threshold value DHT and the negative threshold value −(DHT), the detection unit 140 determines that those difference values are smaller than the negative threshold value −(DHT), and thus determines that the single dot, texts or lines are present in the content. Accordingly, the detection unit 140 outputs the control code VC with a corresponding status.

In this embodiment, the compensation unit 160 only performs the keep operation. In greater detail, the compensation unit 160 generates the first one of the pixel values P2 as being the predetermined portion of the data value R, corresponding to the pixel 402, of the video signal VS, and generates the second one of the pixel values P2 as being the predetermined portion of the data value of green, corresponding to the pixel 402, of the video signal VS.

Figure 4C:
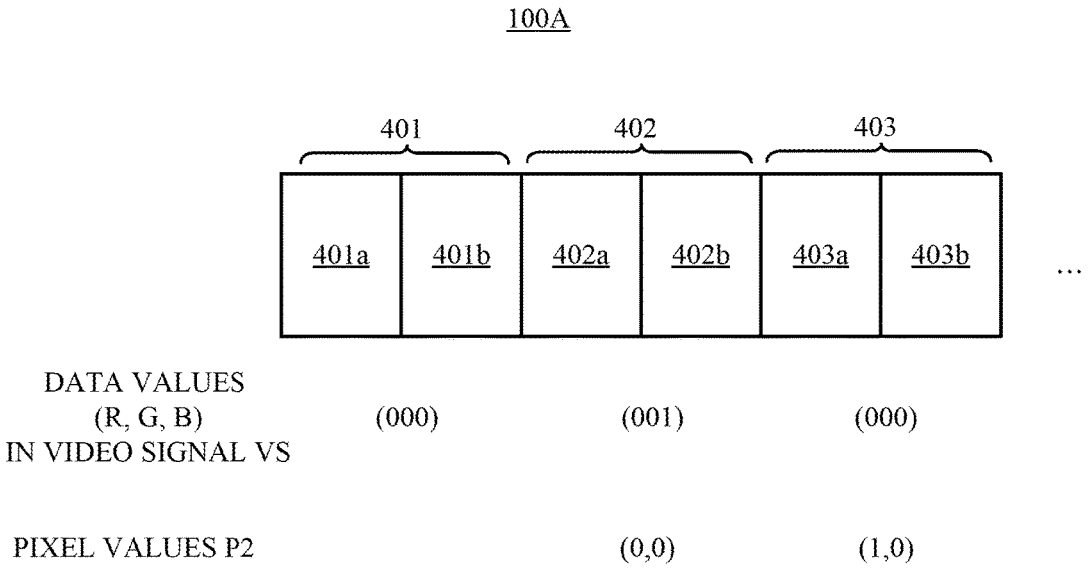
FIG. 4C is a schematic diagram illustrating operations of generating pixels values P2 for the pixels according to some embodiments of the present disclosure.

Reference is now made to FIG. 4C. FIG. 4C is a schematic diagram illustrating operations of generating pixels values P2 for the pixels according to some embodiments of the present disclosure. Compared to FIG. 4A, in this example, the data values R, G, and B, corresponding to the pixel 401, of the video signal VS is (000). The data values R, G, and B, corresponding to the pixel 402, of the video signal VS is (001). The data values R, G, and B, corresponding to the pixel 403, of the video signal VS is (000). In other words, the pixel 401 is expected to display black, the pixel 402 is expected to display blue, and the pixel 403 is expected to display black. That is, a color transition from black to blue is present in the successive pixels. Under this circumstance, the detection unit 140 obtains that the difference values ΔP21(R)=0, ΔP21(0)=0, and ΔP21(B)=1, and the difference values ΔP23(R)=0, ΔP23(G)=0, ΔP23(B)=1. By comparing those difference values with the positive threshold value DHT and the negative threshold value −(DHT), the detection unit 140 determines that the difference values ΔP21(B) and ΔP23(B) are greater than the positive threshold value DHT. Accordingly, the detection unit 140 outputs the control code VC with a corresponding status. Similarly, the compensation unit 160 performs the keep operation and the borrow operation, and thus the repetitious descriptions are not given here.

Further, for the arrangement shown in FIG. 3E, the compensation unit 160 performs the borrow operation according to a corresponding position of the pixel. In greater detail, as shown in FIG. 3E, for the pixels 331 at the odd rows, the third one of the pixel values P2 corresponds to the sub-pixel 332*a*. For the pixel 332 at the odd rows, the third one of the pixel values P2 corresponds to the sub-pixel 333*a*. Similarly, for the pixel 334 at the even rows, the third one of the pixel values P2 corresponds to the sub-pixel 335*a*. Relatively, for the pixel 333 at the odd rows, the third one of the pixel values P2 corresponds to the sub-pixel 332*b*. For the pixel 335, the third one of the pixel values P2 corresponds to the sub-pixel 334*b*. Similarly, for the pixel 336 at the even rows, the third of the pixel values P2 corresponds to the sub-pixel 335*b*. Through such arrangement, the compensated color can be uniformly displayed by adjacent sub-pixels.

In some embodiments, the detection unit 160 includes a code table, in which the code table, e.g., Table 1, stores information of a relationship between statutes of the control code VC and comparison results of the difference values ΔP21(x), the difference values ΔP23(x), the positive threshold value DHT, and the negative threshold value −(DHT), where NA indicates "don't care", i.e., the compensation unit 180 does not generate the pixel values P2, U indicates of the keep operation, and the B indicates of the borrow operation. With such the code table, the operations of generating the pixel values can be more efficient.

TABLE 1

| ΔP21(x) | ΔP23(x) | CODE VC | OPERATIONS |
|---|---|---|---|
| >DHT | >DHT | 0 | U, B |
| <−(DHT) | <−(DHT) | 1 | U |
| NA | NA | NA | NA |
| >DHT | NA | NA | NA |
| <−(DHT) | NA | NA | NA |
| NA | >DHT | NA | NA |
| NA | <−(DHT) | NA | NA |

With continued reference to FIG. 2, in step S280, the data re-arrangement unit 180 selectively outputs at least one of the pixel values P1 and the pixel values P2 to the pixels according to the control code VC.

For example, as shown in FIG. 4A, for compensating the color balance, the data re-arrangement unit 180 outputs the first one of the pixel values P2 to the sub-pixel 402*a* of the pixel 402. The data re-arrangement unit 180 outputs the second one of the pixel values P2 to the sub-pixel 402*b* of the pixel 402. The data re-arrangement unit 180 outputs the third one of the pixel values P2 to the sub-pixel 403*a* of the pixel 403. Further, the data re-arrangement unit 180 outputs a first one of the pixel values P1 to the sub-pixel 401*a* of the pixel 401. The data re-arrangement unit 180 outputs a second one of the pixel values P1 to the sub-pixel 401*b* of the pixel 401. The data re-arrangement unit 180 outputs a third one of the pixel values P1 to the sub-pixel 403*b* of the pixel 403. As a result, the color balance and the contrast of the image displayed by the panel 100A are improved.

The above illustrations include exemplary operations, but the operations are not necessarily performed in the order shown. Operations may be added, replaced, changed order, and/or eliminated as appropriate, according to the spirit and scope of various embodiments of the present disclosure.

In various embodiments, the display system 100 is a design tool carried on a non-transitory computer-readable medium storing the driving method 200. In other words, the display system 100 is implemented in hardware, software, firmware, and the combination thereof. For illustration, if speed and accuracy are determined to be paramount, a mainly hardware and/or firmware vehicle is selected and utilized. Alternatively, if flexibility is paramount, a mainly software implementation is selected and utilized.

In summary, the display system and the driving method of the present disclosure are able to improve the image quality from the panel.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display system, comprising:

a sub-pixel rendering circuit configured to generate a plurality of first pixel values for a plurality of pixels according to a video signal;

a detection circuit configured to detect whether at least one of predetermined conditions is present in a content of the video signal, so as to generate a control code;

a compensation circuit configured to generate a plurality of second pixel values for the pixels according to the video signal and the control code; and a data re-arrangement circuit configured to selectively output at least one of the first pixel values and the second pixel values to the pixels according to the control code;

wherein the pixels comprises a first pixel, a second pixel, and a third pixel that are sequentially arranged, each of the first pixel, the second pixel, and the third pixel comprises a first sub-pixel and a second sub-pixel, the first sub-pixel and the second sub-pixel are configured to display two of a first color, a second color, and a third color, and the sub-pixel rendering circuit is configured to generate one of the first pixel values for the first sub-pixel of the second Pixel according to a plurality of weighted coefficients between the second pixel and pixels around the second pixel, and data values of the color, corresponding to the second pixel and the pixels around the second pixel, of the video signal;

wherein the detection circuit is configured to generate a plurality of first difference values and a plurality of second difference values according to data values, corresponding to the first pixel, the second pixel, and the third pixel, of the video signal, and to compare the first difference values and the second difference values with a positive threshold value and a negative threshold value to generate the control code;

wherein the first pixel is disposed adjacent to the second pixel, and the second pixel is disposed adjacent to the third pixel.

2. The display system of claim 1, wherein the first difference values are differences between data values of the first color, the second color, and the third color, corresponding to the first pixel, of the video signal and data values of the first color, the second color, and the third color, corresponding to the second pixel, of the video signal, and the second difference values are differences between the data values of the first color, the second color, and the third color, corresponding to the second pixel, of the video signal and data values of the first color, the second color, and the third color, corresponding to the third pixel, of the video signal.

3. The display system of claim 1, wherein the first pixel, the second pixel, and the third pixel are arranged along a horizontal direction, and when one of the first difference values and one of the second difference values are greater than the positive threshold value, or when one of the first difference values and one of the second difference values are smaller than the negative threshold value, the compensation circuit is configured to generate a first one of the second pixel values as being a predetermined portion of the data value of the first color, corresponding to the second pixel, of the video signal, and to generate a second one of the second pixel values as being the predetermined portion of the data value of the second color, corresponding to the second pixel, of the video signal, wherein the first one of the second pixel values corresponds to the first sub-pixel of the second pixel, and the second one of the second pixel values corresponds to the second sub-pixel of the second pixel.

4. The display system of claim 3, wherein when the one of the first difference values and the one of the second difference values are greater than the positive threshold value, the compensation circuit is further configured to generate a third one of the second pixel values as being the predetermined portion of the data value of the third color, corresponding to the second pixel, of the video signal, wherein the third one of the second pixel values corresponds to the first sub-pixel of the third pixel.

5. The display system of claim 4, wherein the data re-arrangement circuit is configured to output the first one of the second pixel values to the first sub-pixel of the second pixel, to output the second one of the second pixel values to the second sub-pixel of the second pixel, to output the third one of the second pixel values to the first sub-pixel of the third pixel, to output a first one of the first pixel values to the first sub-pixel of the first pixel, to output a second one of the first pixel values to the second sub-pixel of the first pixel, and to output a third one of the first pixel values to the second sub-pixel of the third pixel according to the control code.

6. The display system of claim 1, wherein the first pixel, the second pixel, and the third pixel are arranged along a horizontal direction, and the first sub-pixel and the second sub-pixel of the first pixel and the first sub-pixel of the second pixel are arranged in a delta arrangement to display the first color, the second color, and the third color, respectively, and when one of the first difference values and one of the second difference values are greater than the positive threshold value, or when one of the first difference values and one of the second difference values are smaller than the negative threshold value, the compensation unit is configured to generate a first one of the second pixel values as being a predetermined portion of the data value of the first color, corresponding to the second pixel, of the video signal, and to generate a second one of the second pixel values as being the predetermined portion of the data value of the second color, corresponding to the second pixel, of the video signal, wherein the first one of the second pixel values corresponds to the first sub-pixel of the second pixel, and the second one of the second pixel values corresponds to the second sub-pixel of the second pixel.

7. The display system of claim 6, wherein when the one of the first difference values and the one of the second difference values are greater than the positive threshold value, the compensation unit is further configured to generate a third one of the second pixel values as being the predetermined portion of the data value of the third color, corresponding to the second pixel, of the video signal, wherein the third one of the second pixel values corresponds to the first sub-pixel of the third pixel or the second sub-pixel of the first pixel.

8. The display system of claim 1, wherein the detection circuit comprises a code table, and the code table is configured to store information of a relationship between statutes of the control code and a plurality of comparison results of the first difference values, the second difference values, the positive threshold value, and the negative threshold value.

9. A method for driving a plurality of pixels, comprising:

generating a plurality of first pixel values for a plurality of pixels, by a sub-pixel rendering circuit, according to a video signal;

detecting whether at least one of predetermined conditions is present in a content of the video signal, by a detection circuit, so as to generate a control code, generating a plurality of second pixel values for the pixels, by a compensation circuit, according to the video signal and the control code; and selectively outputting at least one of the first pixel values and the second pixel values to the pixels, by a data re-arrangement circuit, according to the control code, wherein the pixels comprises a first pixel, a second pixel, and a third pixel that are sequentially arranged, each of the first pixel, the second pixel and the third pixel comprises a first sub-pixel and a second sub-pixel, the first sub-pixel and the second sub-pixel are configured to display two of a first color, a second color, and a third color, and the step of generating the first pixel values comprises:

generating one of the first pixel values for the first sub-pixel of the second pixel according to a plurality of weighted coefficients between the second pixel and pixels around the second pixel, and data values of the color, corresponding to the second pixel and the pixels around the second pixel, of the video signal;

wherein the step generating the control code comprises:

generating a plurality of first difference values and a plurality of second difference values according to data values, corresponding to the first pixel, the second pixel, and the third pixel, of the video signal, and to compare the first difference values and the second difference values with a positive threshold value and a negative threshold value to generate the control code;

wherein the first pixel is disposed adjacent to the second pixel, and the second pixel is disposed adjacent to the third pixel.

10. The method of claim 9, wherein the first difference values are differences between data values of the first color, the second color, and the third color, corresponding to the first pixel, of the video signal and data values of the first color, the second color, and the third color, corresponding to the second pixel, of the video signal, and the second difference values are differences between the data values of the first color, the second color, and the third color, corresponding to the second pixel, of the video signal and data values of the first color, the second color, and the third color, corresponding to the third pixel, of the video signal.

11. The method of claim 9, wherein the first pixel, the second pixel, and the third pixel are arranged along a horizontal direction, and the step of generating the second pixel values comprises:

when one of the first difference values and one of the second difference values are greater than the positive threshold value, or when one of the first difference values and one of the second difference values are smaller than the negative threshold value, generating a first one of the second pixel values as being a predetermined portion of the data value of the first color, corresponding to the second pixel, of the video signal, and generating a second one of the second pixel values, as being the predetermined portion of the data value of the second color, corresponding to the second pixel, of the video signal, wherein the first one of the second pixel values corresponds to the first sub-pixel of the second pixel, and the second one of the second pixel values corresponds to the second sub-pixel of the second pixel.

12. The method of claim 11, wherein when the one of the first difference values and the one of the second difference values are greater than the positive threshold value, the step of generating the second pixel values further comprises:

generating a third one of the second pixel values as being the predetermined portion of the data value of the third color, corresponding to the second pixel, of the video signal, wherein the third one of the second pixel values corresponds to the first sub-pixel of the third pixel or the second sub-pixel of the first pixel.

13. The method of claim 12, wherein the step of selectively outputting at least one of the first pixel values and the second pixel values comprises:

outputting the first one of the second pixel values to the first sub-pixel of the second pixel, outputting the second one of the second pixel values to the second sub-pixel of the second pixel;

outputting the third one of the second pixel values to the first sub-pixel of the third pixel;

outputting a first one of the first pixel values to the first-sub pixel of the first pixel;

outputting a second one of the first pixel values to the second-sub pixel of the first pixel; and outputting a third one of the first pixel values to the second-sub pixel of the third pixel according to the control code.

14. The method of claim 9, wherein the first pixel, the second pixel, and the third pixel are arranged along a horizontal direction, and the first sub-pixel and the second sub-pixel of the first pixel and the first sub-pixel of the second pixel are arranged in a delta arrangement to display the first color, the second color, and the third color, respectively, and the step of generating the second pixel values comprises:

when one of the first difference values and one of the second difference values are greater than the positive threshold value, or when one of the first difference values and one of the second difference values are smaller than the negative threshold value, generating a first one of the second pixel values as being a predetermined portion of the data value of the first color, corresponding to the second pixel, of the video signal, and generating a second one of the second pixel values as being the predetermined portion of the data value of the second color, corresponding to the second pixel, of the video signal, wherein the first one of the second pixel values corresponds to the first sub-pixel of the second pixel, and the second one of the second pixel values corresponds to the second sub-pixel of the second pixel.

15. The method of claim 14, wherein when the one of the first difference values and the one of the second difference values are greater than the positive threshold value, and the step of generating the second pixel values further comprises:

generating a third one of the second pixel values as being the predetermined portion of the data value of the third color, corresponding to the second pixel, of the video signal, wherein the third one of the second pixel values corresponds to the first sub-pixel of the third pixel or the second sub-pixel of the first pixel.

16. The method of claim 9, further comprising:

storing information of a relationship between statutes of the control code and a plurality of comparison results of the first difference values, the second difference values, the positive threshold value, and the negative threshold value to a code table of the detection circuit.

* * * * *